US007530655B2

(12) United States Patent
Yamanobe

(10) Patent No.: US 7,530,655 B2
(45) Date of Patent: May 12, 2009

(54) IMAGE FORMING APPARATUS AND METHOD

(75) Inventor: Jun Yamanobe, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 41 days.

(21) Appl. No.: 11/712,524

(22) Filed: Mar. 1, 2007

(65) Prior Publication Data

US 2007/0206041 A1 Sep. 6, 2007

(30) Foreign Application Priority Data

Mar. 3, 2006 (JP) ..... 2006-058496

(51) Int. Cl.
*B41J 2/205* (2006.01)

(52) U.S. Cl. ..... 347/15; 347/40

(58) Field of Classification Search ..... 347/9, 347/12, 15, 40–44, 47
See application file for complete search history.

(56) References Cited

U.S. PATENT DOCUMENTS 6,846,066 B2 1/2005 Teshikawara et al.
6,877,833 B2 * 4/2005 Teshigawara et al. ..... 347/15
2006/0284913 A1 * 12/2006 Takanose et al. ..... 347/15

FOREIGN PATENT DOCUMENTS

JP 2004-148723 A 5/2004
JP 2005-153435 A 6/2005
JP 2005-205718 A 8/2005
WO WO-2005/120840 A1 12/2005

* cited by examiner

*Primary Examiner*—Thinh H Nguyen
(74) *Attorney, Agent, or Firm*—Birch, Stewart, Kolasch & Birch LLP

(57) ABSTRACT

The image forming apparatus includes: large nozzles which eject large droplets of liquid, the large droplets being deposited onto a recording medium and forming large dots; small nozzles which eject small droplets of the liquid of volume smaller than the large droplets, the small droplets being deposited onto the recording medium and forming small dots smaller than the large dots; a color conversion processing device which converts input image data into ink volume data; a dot information acquisition device which acquires dot information relating to the large dots and the small dots on the recording medium; and a correction processing device which corrects the ink volume data according to the dot information.

5 Claims, 8 Drawing Sheets

IMAGE FORMING APPARATUS AND METHOD

BACKGROUND OF THE INVENTION

1. Field of the Invention

The present invention relates to an image forming apparatus and an image forming method, and more particularly, to an image forming apparatus having large nozzles and small nozzles which eject liquid droplets of different volumes.

2. Description of the Related Art

An inkjet recording apparatus is known that is provided with large nozzles and small nozzles, which eject droplets of liquid or ink having mutually different volumes to be deposited onto a recording medium to form high-quality images having high tonal graduation. In a thermal jet method, which performs ejection by using heating elements, a composition including large nozzles and small nozzles is particularly beneficial, since it is difficult to achieve satisfactory control of the ejection of liquid droplets having different volumes from the same nozzle, in comparison with a piezoelectric method using piezoelectric elements as actuators.

Banding or non-uniformities may occur in the recorded image due to errors in the droplet ejection characteristics, such as the ejection volume, deposition position, or the like, of the liquid droplets ejected from the respective nozzles. As a method of reducing the visibility of banding and non-uniformities, Japanese Patent Application Publication No. 2004-148723, for example, discloses a method for arranging the dot pattern in such a manner that large and small dots formed by droplets ejected from large nozzles and small nozzles do not overlap with each other. Moreover, Japanese Patent Application Publication No. 2005-153435 discloses a method according to which large nozzles and small nozzles are alternatively arranged so that the intervals between large dots are covered over by small dots without leaving any spaces.

Furthermore, Japanese Patent Application Publication No. 2005-205718 discloses another method for reducing the visibility of banding and non-uniformities in an inkjet recording apparatus that performs recording by means of a so-called multi-pass method, in which the paper conveyance amounts for passes are changed in accordance with the error in the deposition positions of the liquid droplets ejected from the nozzles so that the combination of the nozzles is optimized to reduce the visibility of banding and non-uniformities.

However, the methods disclosed in Japanese Patent Application Publication Nos. 2004-148723 and 2005-153435 seek to reduce the visibility of banding and non-uniformities by appropriately adjusting the arrangement of the dot pattern or the nozzle arrangement, and they do not take any consideration of error in the droplet ejection characteristics of the large nozzles and the small nozzles. In general, in a composition including large nozzles and small nozzles, the large nozzles and the small nozzles do not display the same error tendencies in terms of their droplet ejection characteristics. Consequently, in these methods, there are limitations on the reduction of the visibility of banding and non-uniformities, and it is difficult to further improve the image quality.

In the method disclosed in Japanese Patent Application Publication No. 2005-205718, the fact that the paper conveyance amounts are not uniform is liable to place a burden on the paper conveyance system, and is likely to give rise to greater overall size of the inkjet recording apparatus, and increased costs. Moreover, this method is premised on an apparatus based on the multi-pass system, and it cannot be applied to a so-called single-pass system. Furthermore, using this method in a composition including large nozzles and small nozzles is problematic, since the large nozzles and the small nozzles do not have the same error tendencies in terms of the droplet ejection characteristics, as described above, and therefore it is not appropriate for images composed of large dots and small dots.

SUMMARY OF THE INVENTION

The present invention has been contrived in view of the foregoing circumstances, an object thereof being to provide an image forming apparatus and an image forming method which is capable of forming high-quality images free of banding and non-uniformities.

In order to attain the aforementioned object, the present invention is directed to an image forming apparatus, comprising: large nozzles which eject large droplets of liquid, the large droplets being deposited onto a recording medium and forming large dots; small nozzles which eject small droplets of the liquid of volume smaller than the large droplets, the small droplets being deposited onto the recording medium and forming small dots smaller than the large dots; a color conversion processing device which converts input image data into ink volume data; a dot information acquisition device which acquires dot information relating to the large dots and the small dots on the recording medium; and a correction processing device which corrects the ink volume data according to the dot information.

According to this aspect of the present invention, since the ink volume data is corrected on the basis of the dot information relating to the large dots and the small dots formed by droplets ejected from the large nozzles and the small nozzles, then even if the large nozzles and the small nozzles have different droplet ejection characteristics, effective correction can still be achieved according to the image density, and high-quality images free of banding or non-uniformities can be formed.

Moreover, since the correction can be achieved while maintaining a uniform conveyance amount of the recording medium, rather than changing the conveyance amount in accordance with the differences in the droplet ejection characteristics of the large nozzles and the small nozzles, then no burden is placed on the recording medium conveyance system and the overall size of the apparatus can be reduced, as well as lowering costs.

Preferably, the correction processing device corrects the ink volume data according to dot formation rates of the large nozzles and the small nozzles as calculated from the ink volume data.

Here, the "dot formation rates of the large nozzles and the small nozzles" means the formation rates of the large dots and the small dots formed by droplets ejected from the large nozzles and the small nozzles (namely, the number of droplets ejected per unit surface area).

Preferably, the dot information indicates dot formation positions of the large dots and the small dots on the recording medium.

Preferably, the dot information indicates densities of the large dots and the small dots on the recording medium.

In order to attain the aforementioned object, the present invention is also directed to an image forming method for an image forming apparatus having large nozzles and small nozzles, the large nozzles ejecting large droplets of liquid, the large droplets being deposited onto a recording medium and forming large dots, the small nozzles ejecting small droplets of the liquid of volume smaller than the large droplets, the small droplets being deposited onto the recording medium and forming small dots smaller than the large dots, the method comprising the steps of: converting input image data into ink volume data; acquiring dot information relating to the large dots and the small dots on the recording medium; calculating correction coefficients for the ink volume data according to the dot information; and applying the correction coefficients to the ink volume data.

According to the present invention, since the ink volume data is corrected on the basis of the dot information relating to the large dots and the small dots formed by droplets ejected from the large nozzles and the small nozzles, then even if the large nozzles and the small nozzles have different droplet ejection characteristics, effective correction can still be achieved according to the image density, and high-quality images free of banding or non-uniformities can be formed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

FIGS. 1 to 5 are diagrams for describing image processing according to an embodiment of the present invention. As described below, an inkjet recording apparatus according to the present embodiment has a large nozzle row and a small nozzle row for each of colors of ink. In the large nozzle row, a plurality of large nozzles for ejecting large droplets of the ink are arranged following a paper conveyance direction (sub-scanning direction), and in the small nozzle row, a plurality of small nozzles for ejecting small droplets of the ink are similarly arranged. The inkjet recording apparatus forms a desired image by means of a so-called shuttle recording method, in which the large and small nozzles eject ink droplets of the prescribed sizes toward the paper, while repeatedly scanning the paper with the large and small nozzle rows in a direction (main scanning direction) perpendicular to the paper conveyance direction. Below, the image processing carried out in this inkjet recording apparatus is described.

Figure 1:
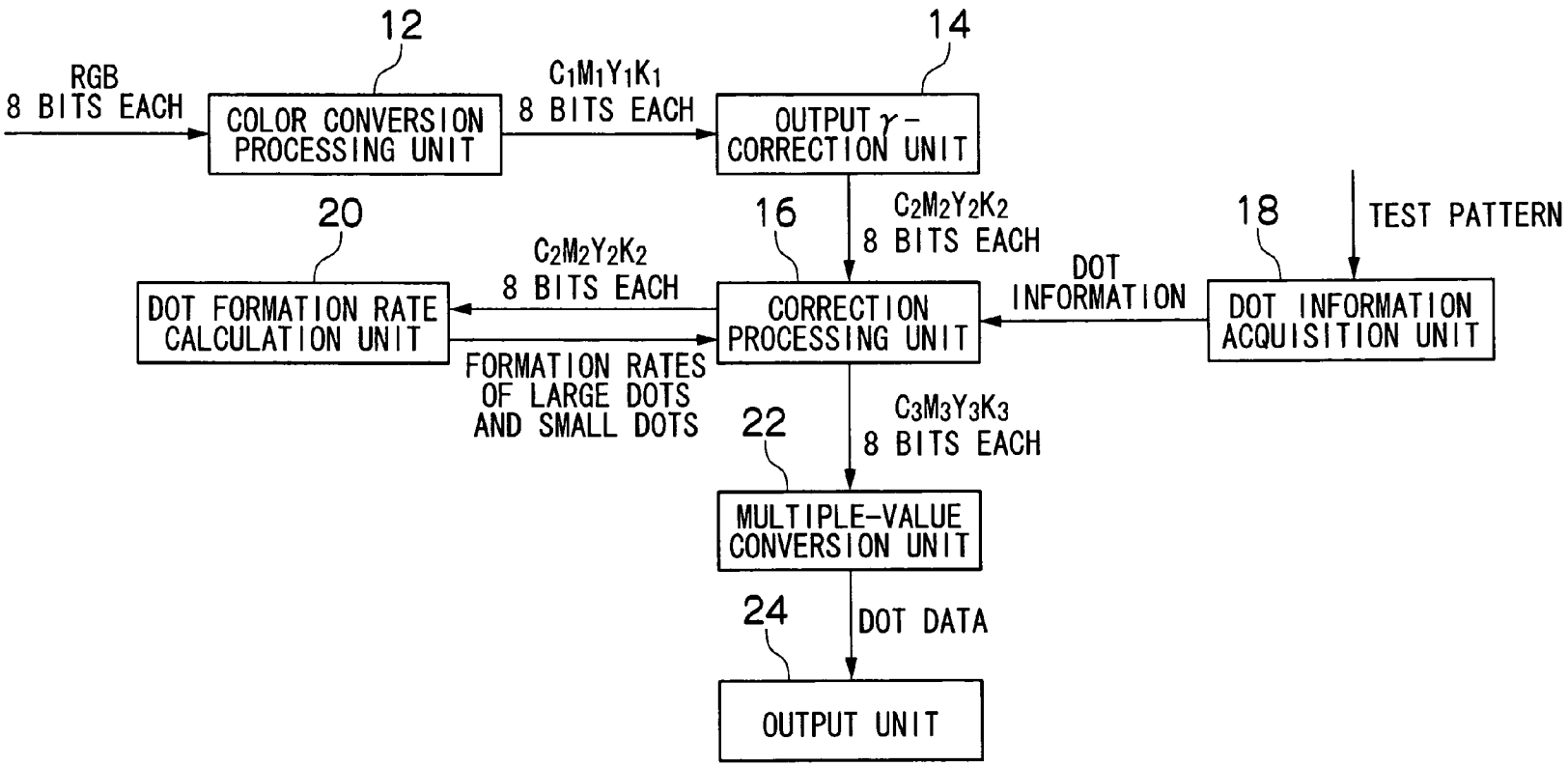
FIG. 1 is a schematic drawing of image processing carried out in an inkjet recording apparatus forming an embodiment of the present invention.
Figure 2:
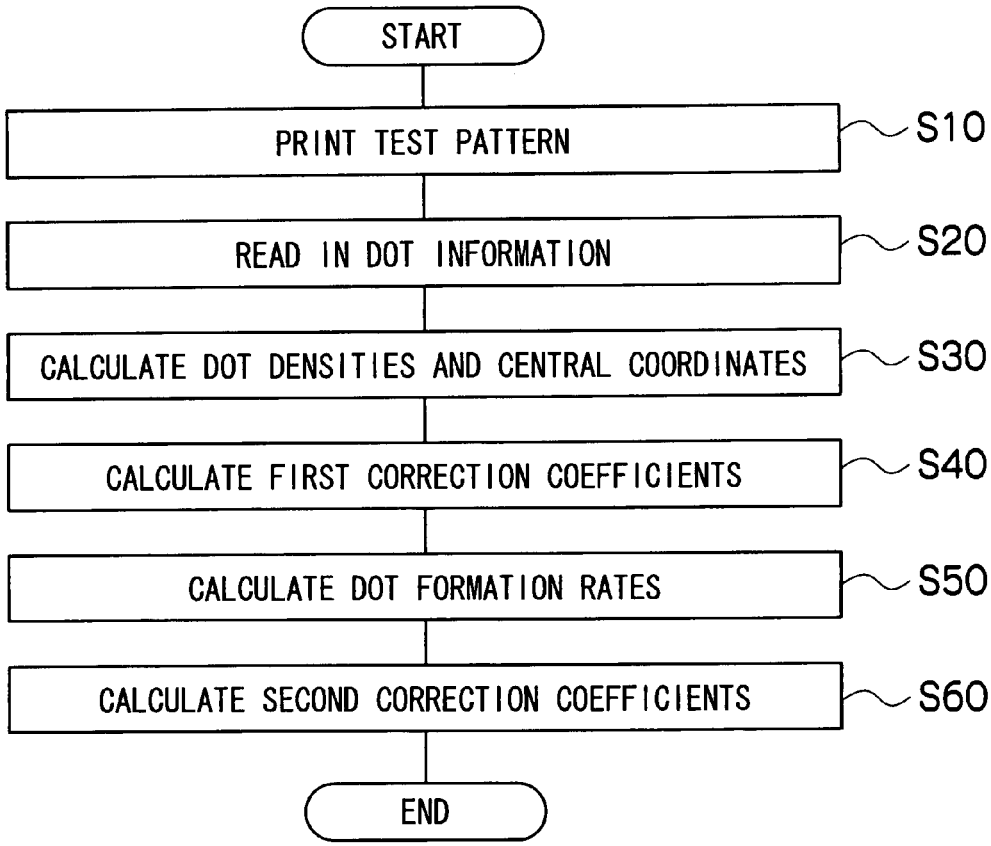
FIG. 2 is a flow diagram showing a calculation procedure for a correction coefficient.

In FIG. 1, image data inputted from a host computer 186 (see FIG. 9) are sent to a color conversion processing unit 12. In the color conversion processing unit 12, the input image data are color-converted into ink volume data corresponding to the colored inks used in the inkjet recording apparatus. FIG. 1, for example, shows a case where the image data (RGB; 8-bits each), which are composed of 8-bit data for each of colors of red (R), green (G) and blue (B), are color converted into ink volume data ($C_1M_1Y_1K_1$; 8-bits each) corresponding to the inks of the colors: cyan (C), magenta (M), yellow (Y) and black (K). The ink volume data ($C_1M_1Y_1K_1$; 8-bits each) after the color conversion are sent to an output γ-correction unit 14.

In the output γ-correction unit 14, the y-correction is carried out with respect to the color-converted ink volume data ($C_1M_1Y_1K_1$; 8 bits each). Thereby, a linear relationship is achieved between the γ-corrected ink volume data ($C_1M_1Y_1K_1$; 8-bits each), and the output characteristics of the colored inks. The y-corrected ink volume data ($C_2M_2Y_2K_2$; 8-bits each) are sent to a correction processing unit 16.

In the correction processing unit 16, correction coefficients (second correction coefficients) are calculated for the γ-corrected ink volume data ($C_2M_2Y_2K_2$; 8-bits each), in coordination with a dot information acquisition unit 18 and a dot formation rate calculation unit 20, and the ink volume data ($C_2M_2Y_2K_2$; 8-bits each) are multiplied by the calculated correction coefficients in order to correct the ink volume data ($C_2M_2Y_2K_2$; 8-bits each). More specifically, the correction coefficients (the second correction coefficients) for the ink volume data are calculated in the calculation procedure shown in FIG. 2, which is described below. Although the description here relates to only one color of ink in order to simplify the description, the correction coefficients are actually derived by the same method for the ink colors of C, M, Y and K, respectively.

Figure 3:
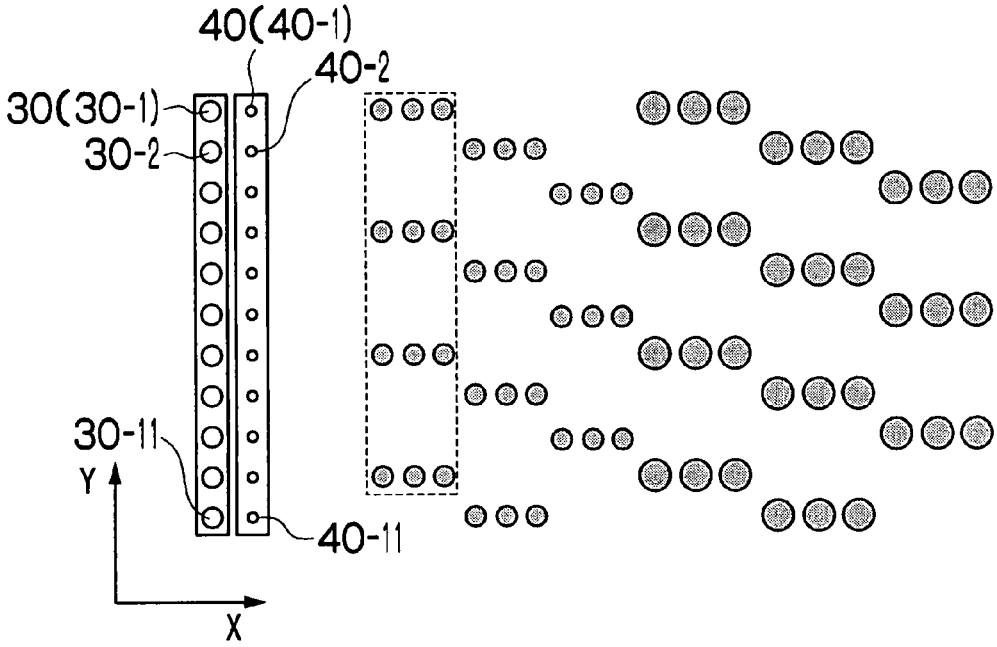
FIG. 3 is a diagram showing one embodiment of a test pattern.

Firstly, a test pattern is printed (step S10). FIG. 3 shows an example of the test pattern according to the embodiment of the present invention. The nozzle rows (the large nozzle row and the small nozzle row) are shown on the left-hand side in FIG. 3. In the nozzle rows, a plurality of large nozzles 30 (30-1, . . . , 30-11) for ejecting large droplets and a plurality of small nozzles 40 (40-1, . . . , 40-11) for ejecting small droplets are arranged in the Y direction, which corresponds to the paper conveyance direction. The number m (m=1, . . . , 11) after the hyphen "-" in the reference numeral of each nozzle indicates the nozzle number, and the nozzles having the same nozzle number (the large nozzle 30-*m* and the small nozzle 40-*m*) deposit ink droplets to form dots of the prescribed sizes (the large dot and the small dot), at substantially the same position in terms of the Y direction, which corresponds to the sub-scanning direction on the recording medium (the paper conveyance direction). A test pattern having stages as shown in FIG. 3 is formed by ejecting ink droplets to form three dots from each of the nozzles 30-*m* and 40-*m* (m=1, . . . , 11) in a prescribed sequence, while relatively moving the nozzle rows with respect to the recording medium in the X direction, which corresponds to the main scanning direction. It is preferable that the droplets are deposited at positions that are suitably distant from each other to prevent any of the dots overlapping with another dot. Of course, the test pattern is not limited to the embodiment shown in FIG. 3.

Next, the dot information is read in (step S20), and the densities and the central coordinates of the dots are calculated on the basis of the dot information thus acquired (step S30). More specifically, the following processing is carried out.

Figure 4:
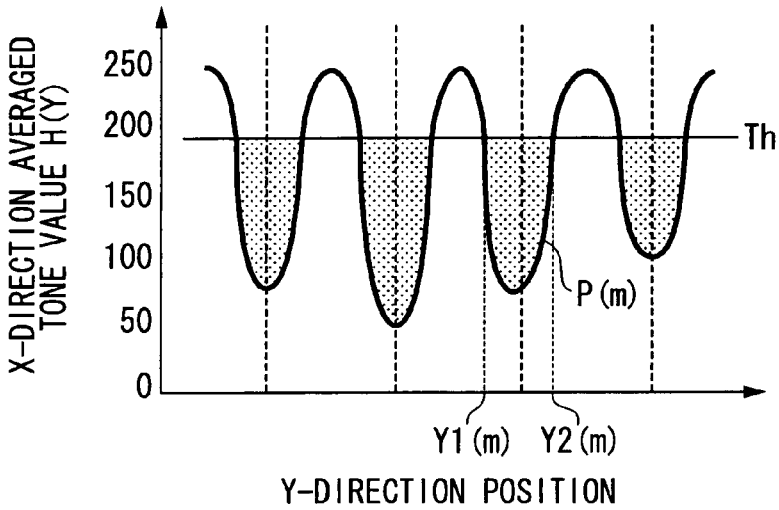
FIG. 4 is a diagram showing the results of reading in a test pattern by means of a dot information acquisition unit.

In the dot information acquisition unit 18, the test pattern is read in through a scanner, or the like, and the densities of the dots aligned in the X direction are averaged for a prescribed region (e.g., the range defined by the dashed lines in FIG. 3). FIG. 4 shows the results by way of example. In FIG. 4, the horizontal axis indicates the Y-direction position in FIG. 3, and the vertical axis indicates the tone value H(Y) averaged in the X direction in FIG. 3. A portion of the graph having a low value in the X-direction averaged tone value (in other words, having a high density) indicates that a dot is present at the corresponding position in the Y direction.

In the correction processing unit 16, the dot densities and the central coordinates are calculated for the large and small nozzles as described below, on the basis of the results obtained above (the dot status data for the nozzles). In FIG. 4, an arbitrary threshold value (Th) is set for the X-direction averaged tone value, and in the areas defined by this threshold value (Th) and the graph, the surface area of the region P below the threshold value (Th) (which region is shaded on FIG. 4) is determined and the value of this surface area is taken to be the density of the corresponding dot. Moreover, the Y coordinate of the center of gravity of the region P is taken to be the central coordinate of the corresponding dot in the Y direction. In other words, the density D(m) and the central coordinate Y(m) of the dot formed by the m-th nozzle (large nozzle 30-*m* or small nozzle 40-*m*) are determined as:

$$D(m) = \sum_{Y=Y1(m)}^{Y2(m)} (Th - H(Y)); \tag{1}$$

and $$Y(m) = \frac{\sum_{Y=Y1(m)}^{Y2(m)} [Y \cdot (Th - H(Y))]}{\sum_{Y=Y1(m)}^{Y2(m)} (Th - H(Y))}, \tag{2}$$

where Y1(m) and Y2(m) are the minimum value and the maximum value, respectively, of the coordinates of the Y-direction positions of the region P corresponding to the m-th nozzle. In other words, Y1(m) is the Y-direction position at which the X-direction average tone value H(Y) passes the threshold value Th from the upper side to the lower side, and Y2(m) is the Y-direction position at which the X-direction average tone value H(Y) passes the threshold value Th from the lower side to the upper side.

Next, the first correction coefficients corresponding to the large and small nozzles 30-*m* and 40-*m* (m=1, . . . , 11) are calculated (step S40). The first correction coefficients are calculated by the correction processing unit 16. The first correction coefficient kL(m) for the m-th large nozzle 30-*m* is determined as:

$$kL(m) = \frac{1}{DL(m)} \cdot \left( \frac{\Delta YL(m-1, m) + \Delta YL(m, m+1)}{2} \right), \tag{3}$$

where DL(m) is the ratio of the density of the large dot formed by the m-th large nozzle 30-*m*, with respect to the average density of all of the large dots, and ΔYL(i, i+1) is the ratio of the dot pitch (the distance between the centers of the dots) in the Y direction between the large dots formed by the i-th large nozzle 30-*i* and the (i+1)-th large nozzle 30-(*i*+1), with respect to a reference dot pitch.

Similarly, the first correction coefficient kS(m) for the m-th small nozzle 40-*m* is determined as:

$$kS(m) = \frac{1}{DS(m)} \cdot \left( \frac{\Delta YS(m-1, m) + \Delta YS(m, m+1)}{2} \right), \tag{4}$$

where DS(m) is the ratio of the density of the small dot formed by the m-th small nozzle 40-*m*, with respect to the average density of all of the small dots, and ΔYS(i, i+1) is the ratio of the dot pitch in the Y direction between the small dots formed by the i-th small nozzle 40-*i* and the (i+1)-th small nozzle 40-(*i*+1), with respect to a reference dot pitch.

According to Formula (3), for example, if the density of the large dot formed by the large nozzle 30-*m* is lower than the average, then the first correction coefficient kL(m) becomes larger, and hence a liquid droplet larger than the average will be ejected from the large nozzle 30-*m*. If the density of the large dot formed by the large nozzle 30-*m* is higher than the average, then the first correction coefficient kL(m) determined as described above becomes smaller, and hence a liquid droplet smaller than the average is ejected from the large nozzle 30-*m*. Furthermore, if the pitch between the dot formed by the large nozzle 30-*m* and the dots formed by the large nozzles 30-(*m*−1) and 30-(*m*+1) adjacent in the Y direction is longer than the average, then the first correction coefficient kL(m) becomes larger, and hence a liquid droplet larger than the average will be ejected from the large nozzle 30-*m*. If the pitch between the dot formed by the large nozzle 30-*m* and the dots formed by the large nozzles 30-(*m*−1) and 30-(*m*+1) adjacent in the Y direction is shorter than the average, then the first correction coefficient kL(m) becomes smaller, and hence a liquid droplet smaller than the average will be ejected from the large nozzle 30-*m*. In other words, the first correction coefficients are coefficients that adjust the volume of the droplets ejected from the large and the small nozzles 30-*m* and 40-*m* (m=1, . . . , 11) in accordance with their droplet ejection characteristics.

Next, the dot formation rates (the numbers of dots formed on a unit surface area) are calculated for the large dots and the small dots (step S50). More specifically, the dot formation rate calculation unit 20 calculates the formation rates of the large dots and the small dots, on the basis of the γ-corrected ink volume data ($C_2M_2Y_2K_2$; 8 bits each).

Figure 5:
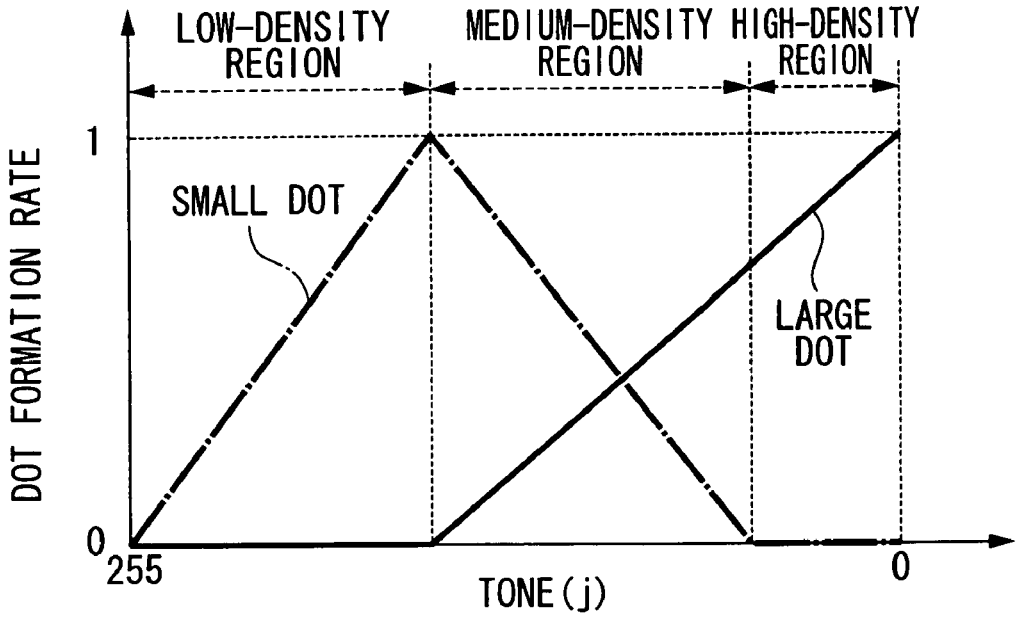
FIG. 5 is a diagram showing the relationship of formation rates of large dots and small dots to ink volume data.

FIG. 5 shows an embodiment of the relationship of the formation rates of the large dots and the small dots to the ink volume data (8-bit data) for one color of ink. In FIG. 5, the horizontal axis indicates the tone (j) of the ink volume data, and the vertical axis represents the formation rate of the dots. As shown in FIG. 5, only small dots are formed in the low-density region, large dots and small dots are formed at a prescribed ratio in the medium-density region, and only large dots are formed in the high-density region. Of course, the relationship between the dot formation rates of the large dots and the small dots to the ink volume data is not limited to the embodiment shown in FIG. 5, and for example, it is also possible to form large dots in the low-density region and it is also possible to form small dots in the high-density region. Here, the function representing the dot formation rate of the large dots to the tone (j) is FL(j), and the function representing the dot formation rate of the small dots to the tone (j) is FS(j). In the present embodiment, the functions FL(j) and FS(j) are beforehand prepared for each color of ink and stored in a memory (not shown), and the dot formation rate calculation unit 20 calculates the dot formation rates of the large dots and the small dots with the functions FL(j) and FS(j) on the basis of the γ-corrected ink volume data ($C_2M_2Y_2K_2$; 8 bits each) supplied from the correction processing unit 16. The dot formation rates for the large dots and the small dots thus calculated are inputted to the correction processing unit 16.

Thereupon, the second correction coefficients are calculated by the correction processing unit 16 (step S60). Each of the second correction coefficients is calculated for one pair of the large nozzle and the small nozzle that deposit liquid droplets of different sizes onto substantially the same position on the recording medium, in other words, for one pair of the nozzles having the same nozzle number (i.e., the large nozzle 30-*m* and the small nozzle 40-*m*), in the form of the correction coefficient relating to the γ-corrected ink volume data ($C_2M_2Y_2K_2$; 8 bits each). The second correction coefficient k(m, j) is determined as:

$$k(m,\ j) = \frac{FL(j)}{FL(j) + FS(j)} \cdot kL(m) + \frac{FS(j)}{FL(j) + FS(j)} \cdot kS(m). \tag{5}$$

In other words, the second correction coefficient k(m, j) is obtained by adding together the products obtained by multiplying the first correction coefficient kL(m) for the large nozzle 30-*m* and the first correction coefficient kS(m) for the small nozzle 40-*m*, respectively, by the ratio of the large dots and the small dots in the dot formation rate. In Formula (5), for the sake of convenience, the functions FL(j) and FS(j) are used to represent the dot formation rates of the large dots and the small dots.

The second correction coefficient thus obtained is equal to the first correction coefficient kL(m) for the large nozzle 30-*m*, in the high-density region where droplets are deposited to form large dots only; the second correction coefficient is equal to the first correction coefficient kS(m) for the small nozzle 40-*m*, in the low-density region where droplets are deposited to form small dots only; and the second correction coefficient is the proportional sum of the first correction coefficients kL(m) and kS(m) with respect to the large dot formation rate and the small dot formation rate, in the medium-density region where droplets are deposited to form large dots and small dots. Therefore, even if the large nozzle 30-*m* and the small nozzle 40-*m* have different droplet ejection characteristics, it is possible to achieve effective correction with respect to the image density (ink volume data).

In order to correct the γ-corrected ink volume data ($C_2M_2Y_2K_2$; 8 bits each), the correction processing unit 16 multiplies the γ-corrected ink volume data ($C_2M_2Y_2K_2$; 8 bits each) by the second correction coefficients k(m, j) determined as described above. The corrected ink volume data ($C_3M_3Y_3K_3$; 8 bits each) is inputted to a multiple-value conversion unit 22.

The multiple-value conversion unit 22 produces dot data by multiple-value conversion processing on the basis of the input ink volume data ($C_3M_3Y_3K_3$; 8 bits each). The dot data is then sent to an output unit 24, and the nozzles are driven to perform ejection according to the dot data, thereby ejecting droplets to form prescribed dots.

The color conversion processing, the γ correction processing and the multiple-value conversion processing can be performed in commonly known procedures, and detailed descriptions of these are not given here.

Figure 6:
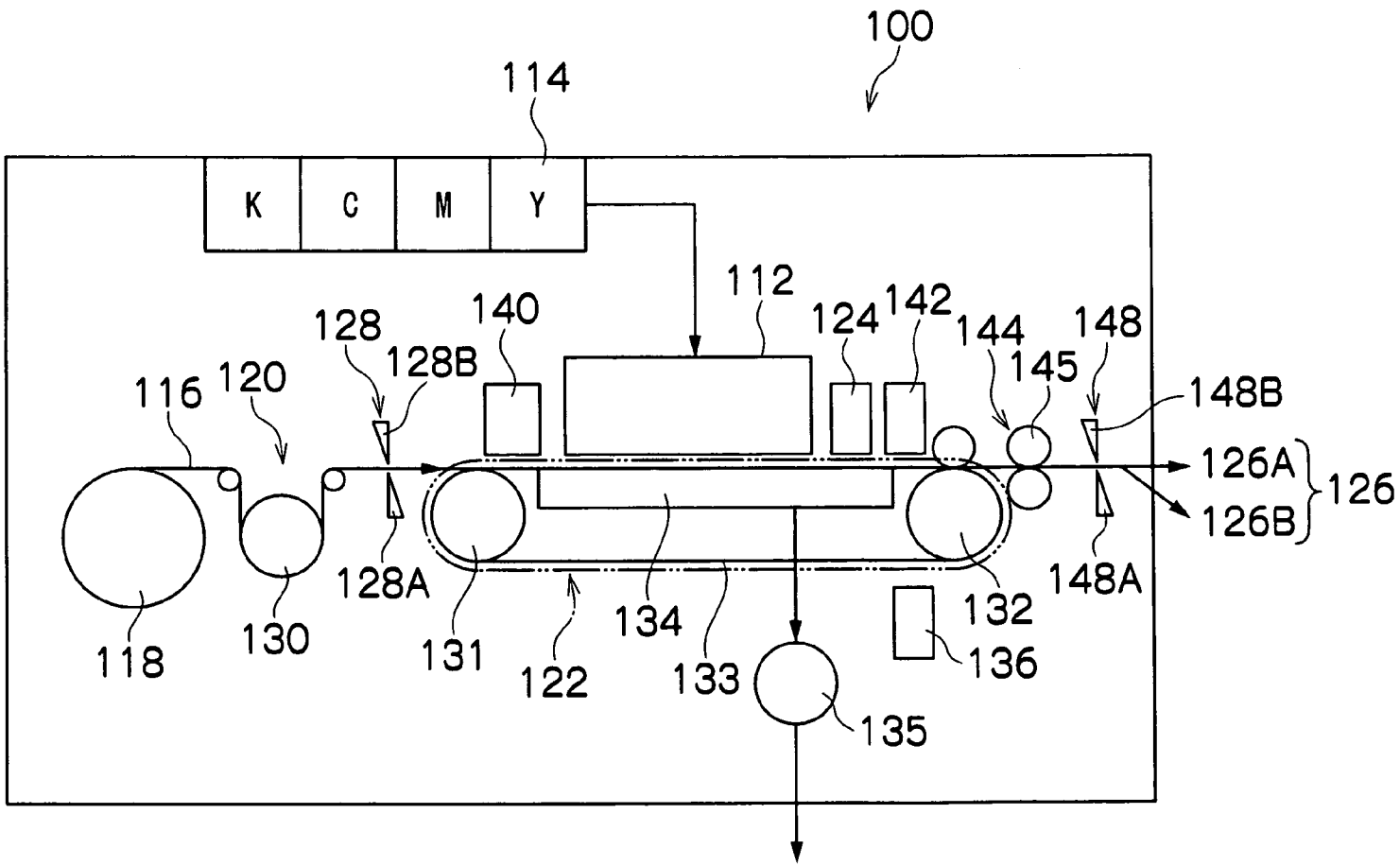
FIG. 6 is a schematic diagram of an inkjet recording apparatus forming an embodiment of the present invention.

Next, the general composition of an inkjet recording apparatus serving as the image forming apparatus according to an embodiment of the present invention is described. FIG. 6 is a general schematic drawing of the inkjet recording apparatus according to the present embodiment. As shown in FIG. 6, the inkjet recording apparatus 100 comprises: a print unit 112 for ejecting inks of the respective colors of black (K), cyan (C), magenta (M), and yellow (Y); an ink storing and loading unit 114 for storing inks to be supplied to the print unit 112; a paper supply unit 118 for supplying recording paper 116; a decurling unit 120 for removing curl in the recording paper 116; a suction belt conveyance unit 122 disposed facing the ink ejection surfaces (nozzle surfaces) of the print unit 112, for conveying the recording paper 116 while keeping the recording paper 116 flat; a print determination unit 124 for reading the printed result produced by the print unit 112; and a paper output unit 126 for outputting image-printed recording paper (printed matter) to the exterior.

In FIG. 6, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 128 is provided as shown in FIG. 6, and the roll paper is cut to a desired size by the cutter 128. The cutter 128 has a stationary blade 128A, whose length is not less than the width of the conveyor pathway of the recording paper 116, and a round blade 128B, which moves along the stationary blade 128A. The stationary blade 128A is disposed on the reverse side of the printed surface of the recording paper 116, and the round blade 128B is disposed on the printed surface side across the conveyance path. When cut paper is used, the cutter 128 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

The decurled and cut recording paper 116 is delivered to the suction belt conveyance unit 122. The suction belt conveyance unit 122 has a configuration in which an endless belt 133 is set around rollers 131, 132 so that the portion of the endless belt 133 facing at least the ink ejection surface of the print unit 112 and the sensor surface of the print determination unit 124 forms a plane.

The belt 133 has a width that is greater than the width of the recording paper 116, and a plurality of suction apertures (not shown) are formed on the belt surface. A suction chamber 134 is disposed in a position facing the sensor surface of the print determination unit 124 and the ink ejection surface of the print unit 112 on the interior side of the belt 133, which is set around the rollers 131, 132, as shown in FIG. 6. The suction chamber 134 provides suction with a fan 135 to generate a negative pressure, and the recording paper 116 on the belt 133 is held by suction.

The belt 133 is driven in the clockwise direction in FIG. 6 by the motive force of a motor (not shown in drawings) being transmitted to at least one of the rollers 131, 132, which the belt 133 is set around, and the recording paper 116 held on the belt 133 is conveyed in a sub-scanning direction, which is a paper conveyance direction (rightward direction in FIG. 6).

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration in which the belt 133 is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus can comprise a roller nip conveyance mechanism, instead of the suction belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the print unit 112 in the conveyance pathway formed by the suction belt conveyance unit 122. The heating fan 140 blows heated air onto the recording paper 116 to heat the recording paper 116 immediately before printing so that the ink deposited on the recording paper 116 dries more easily.

The ink storing and loading unit 114 has a tank for storing inks of respective colors (K, C, M, Y) to be supplied to the print unit 112, and each tank is connected to the print unit 112 by means of a tubing channel (not shown). Moreover, the ink storing and loading unit 114 also comprises a notifying device (display device, alarm generating device, or the like) for generating a notification if the remaining amount of ink has become low, as well as having a mechanism for preventing incorrect loading of ink of the wrong color.

The print determination unit 124 has an image sensor (line sensor) for capturing an image of the ink-droplet deposition result of the print unit 112, and functions as a device to check for ejection defects such as clogs of the nozzles from the ink-droplet deposition results evaluated by the image sensor.

The print determination unit 124 of the present embodiment is configured with a line sensor having rows of photoelectric transducing elements with a width that is greater than the image recording width of the recording paper 116. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 124 reads in the test pattern printed by the print unit 112 and determines the ejection performed by the print unit 112. The ejection determination includes determination of the presence of the dots, measurement of the dot sizes, and measurement of the dot formation positions. In other words, a portion of the print determination unit 124 serves as the dot information acquisition unit 18 shown in FIG. 1. Of course, it is also possible that the print determination unit 124 is composed separately from the dot information acquisition unit 18.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 100, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. The cutter 148 is disposed directly in front of the paper output unit 126, and is used for cutting the test print portion from the target print portion when a test print has been performed in the blank portion of the target print. The structure of the cutter 148 is the same as the first cutter 128 described above, and has a stationary blade 148A and a round blade 148B. Although not shown in the drawing, the paper output unit 126A for the target prints is provided with a sorter for collecting images according to print orders.

Figure 7:
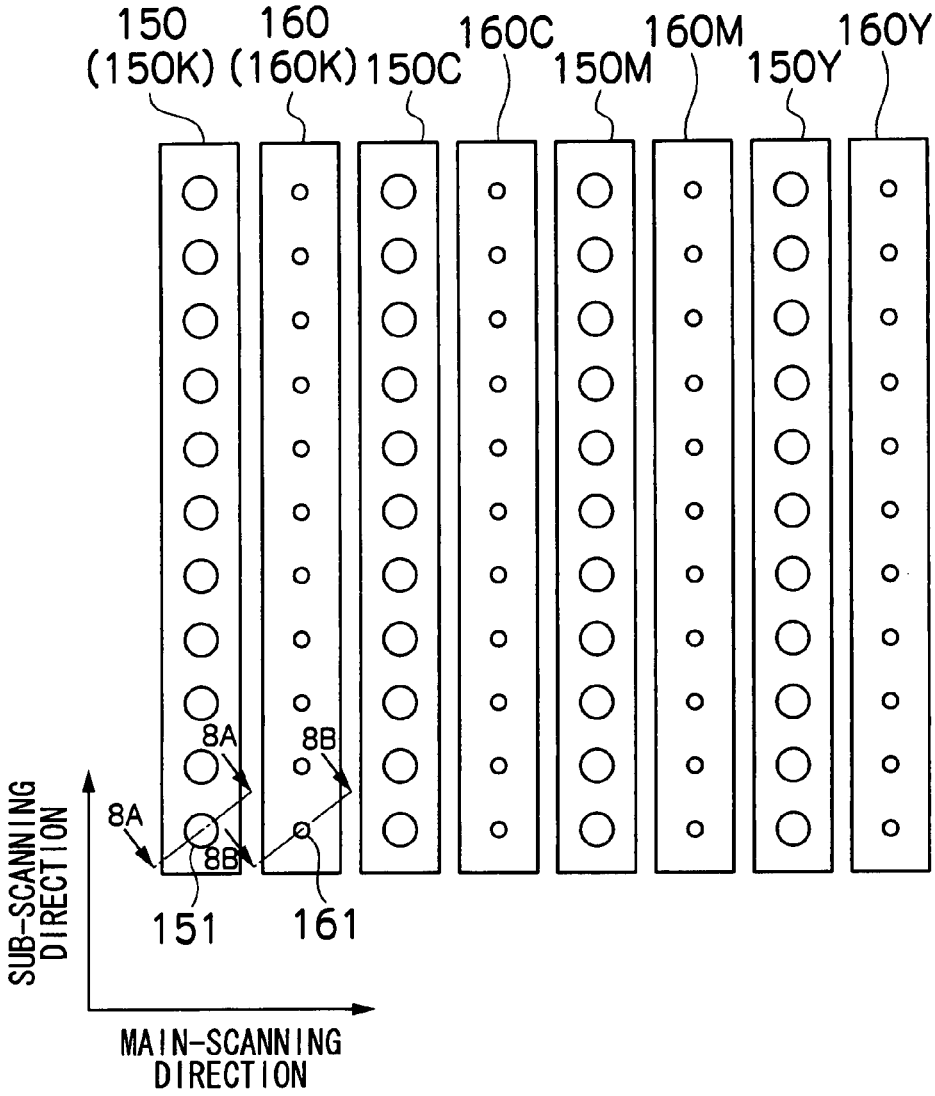
FIG. 7 is a plan diagram showing an ink ejection surface of a print unit.

FIG. 7 is a plan diagram showing the ink ejection surface of the print unit 112. As shown in FIG. 7, the print unit 112 is provided with first heads 150 (150K, 150C, 150M, 150Y) and second heads 160 (160K, 160C, 160M, 160Y) in correspondence with the inks of the respective colors, black (K), cyan (C), magenta (M) and yellow (Y).

In each of the first heads 150, a plurality of large nozzles 151 for ejecting large droplets are arranged following the sub-scanning direction, and each of the large nozzles 151 ejects a large droplet of the corresponding colored ink (K, C, M or Y). In each of the second heads 160, a plurality of small nozzles 161 for ejecting small droplets are arranged following the sub-scanning direction, and each of the small nozzles 161 ejects a small droplet of the corresponding colored ink (K, C, M or Y). The large nozzles 151 and the small nozzles 161 are disposed respectively at substantially the same positions in terms of the sub-scanning direction, in such a manner that they can deposit the liquid droplets of different volumes onto substantially the same positions in the sub-scanning direction.

Figure 8A:
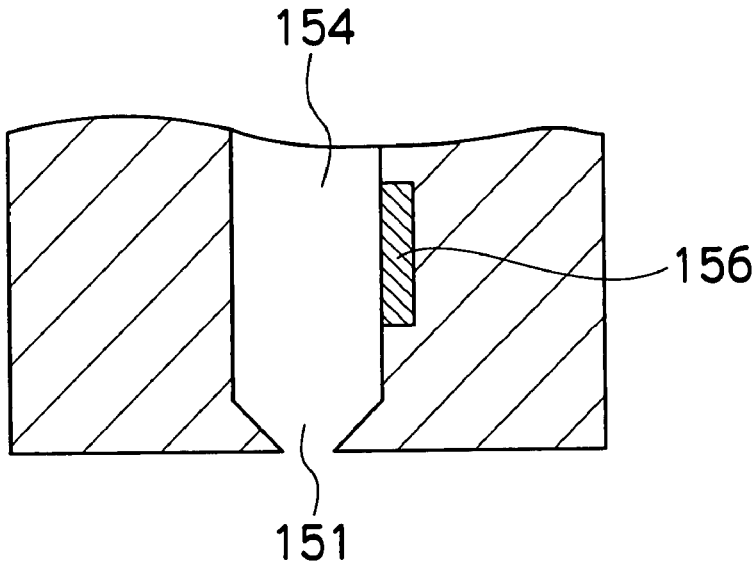
FIGS. 8A and 8B are partial cross-sectional diagrams showing the internal composition of first and second heads, respectively.
Figure 8B:
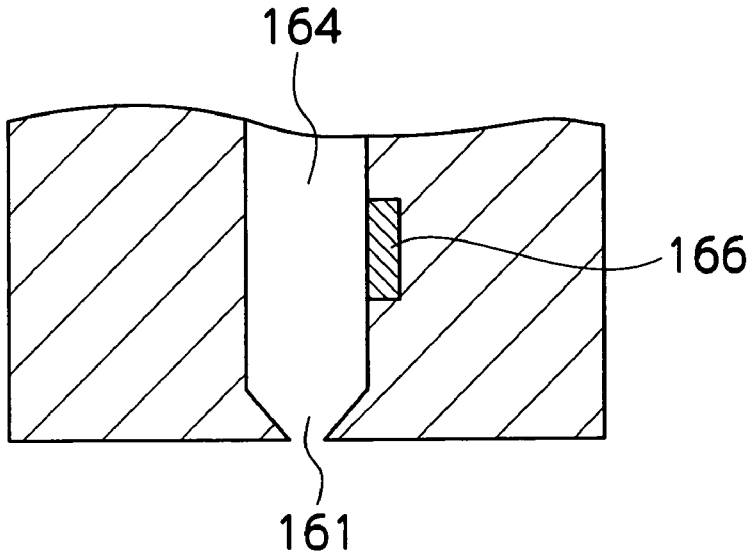

FIGS. 8A and 8B are partial cross-sectional diagrams showing the internal composition of the heads, where FIG. 8A is a cross-sectional diagram of the first head 150 along line 8A-8A in FIG. 7, and FIG. 8B is a cross-sectional diagram of the second head 160 along line 8B-8B in FIG. 7.

As shown in FIG. 8A, each large nozzle 151 is connected to an individual flow channel 154 inside the first head 150. The individual flow channels 154 are provided correspondingly to the large nozzles 151, and are connected to a common flow channel (not shown). Ink of the prescribed color (K, C, M or Y) is supplied from the ink storing and loading unit 114 shown in FIG. 6 to the individual flow channels 154 through the common flow channel. A heating element 156, such as a heater, is arranged on the inner wall of each individual flow channel 154. By applying a prescribed drive voltage to the heating element 156 from a drive circuit (not shown), the ink inside the individual flow channel 154 is heated, thereby generating a bubble, and a large droplet is ejected from the large nozzle 151 due to the pressure created by this bubble.

As shown in FIG. 8B, the second head 160 has the internal structure similar to that of the first head 150, and is provided with individual flow channels 164 connected respectively to the small nozzles 161, and heating elements 166. A small droplet is ejected from the small nozzle 161.

The heads 150 and 160 having the above-described composition are mounted in a carriage (not shown), and a desired image is recorded on the recording paper 116 by ejecting differently sized liquid droplets of the corresponding colored inks from the heads 150 and 160 toward the recording paper 116, while moving the heads 150 and 160 alternately forward and backward in the main scanning direction, which is perpendicular to the sub-scanning direction, and conveying the recording paper 116 in the sub-scanning direction (paper conveyance direction).

In the present embodiment, each of the heads 150 and 160 has a single nozzle row aligned in the sub-scanning direction, but the implementation of the present invention is not limited to this, and a mode is also possible in which each of the heads 150 and 160 has a plurality of nozzle rows. Moreover, it is also possible to adopt a mode in which each nozzle row is composed of large and small nozzles, by, for instance, alternatively arranging the large nozzles 151 and the small nozzles 161. Further, the invention is not limited to the mode where the heads are provided correspondingly for the nozzle rows, as in the present embodiment, and it is also possible to adopt a mode in which heads are provided correspondingly for colors of ink, or a mode where all of the nozzle rows are arranged in a single head.

Furthermore, the present embodiment is described with respect to the shuttle type of inkjet recording apparatus, which performs recording by moving the nozzle rows that are arranged in the paper conveyance direction (sub-scanning direction) alternately forward and backward in the main scanning direction, but the implementation of the present invention is not limited to this. For example, it is also possible to use a line type of inkjet recording apparatus, which has a line head formed with a plurality of large nozzles and small nozzles covering the maximum recordable width of the recording medium, and performs recording by moving this line head in the sub-scanning direction relatively to the recording medium.

Next, the control system of the inkjet recording apparatus 100 is described.

Figure 9:
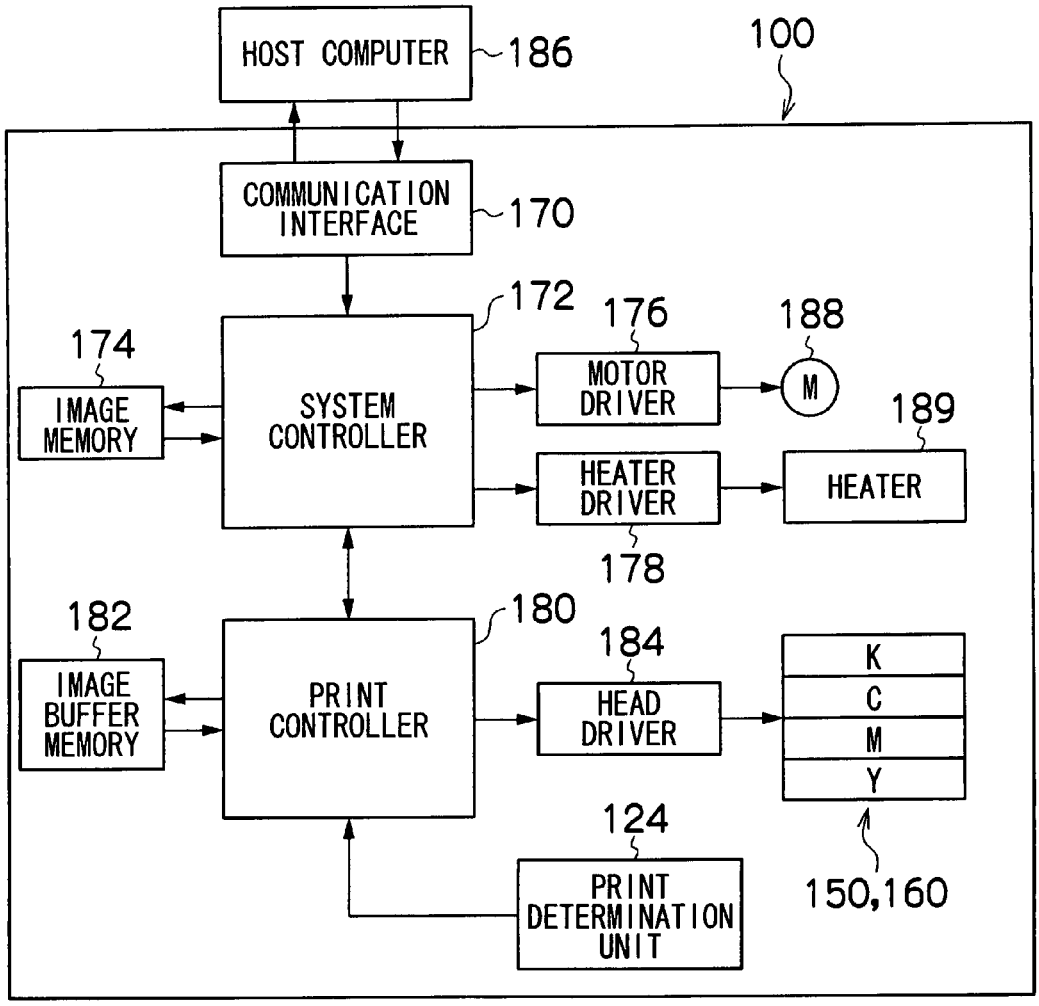
FIG. 9 is a principal block diagram showing the system composition of the inkjet recording apparatus.

FIG. 9 is a principal block diagram showing the system configuration of the inkjet recording apparatus 100. The inkjet recording apparatus 100 comprises a communication interface 170, a system controller 172, an image memory 174, a motor driver 176, a heater driver 178, a print controller 180, an image buffer memory 182, a head driver 184, and the like.

The communication interface 170 is an interface unit for receiving image data sent from a host computer 186. A serial interface or a parallel interface may be used as the communication interface 170. A buffer memory (not shown) may be mounted in this portion in order to increase the communication speed.

The image data sent from the host computer 186 is received by the inkjet recording apparatus 100 through the communication interface 170, and is temporarily stored in the image memory 174. The image memory 174 is a storage device for temporarily storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is a control unit for controlling the various sections, such as the communication interface 170, the image memory 174, the motor driver 176, the heater driver 178, and the like. The system controller 172 is constituted by a central processing unit (CPU) and peripheral circuits thereof, and the like. The system controller 172 controls communications with the host computer 186 and reading and writing from and to the image memory 174, or the like, and generates control signals for controlling the motor 188 of the conveyance system and the heater 189.

The motor driver (drive circuit) 176 drives the motor 188 in accordance with commands from the system controller 172. The heater driver 178 drives the heater 189 of the post-drying unit 142 or other units in accordance with commands from the system controller 172.

The print controller 180 has a signal processing function for performing various tasks, compensations, and other types of processing for generating print control signals from the image data stored in the image memory 174 in accordance with commands from the system controller 172 so as to supply the generated print control signal (dot data) to the head driver 184. Prescribed signal processing is carried out in the print controller 180, and the ejection amounts and the ejection timings of the ink droplets from the print heads 150 and 160 are controlled through the head driver 184, on the basis of the print data. By this means, prescribed dot sizes and dot positions can be achieved. The image processing described above with reference to FIGS. 1 to 5 is mainly performed in the print controller 180.

The print controller 180 is provided with the image buffer memory 182, and image data, parameters, and other data are temporarily stored in the image buffer memory 182 when the image data is processed in the print controller 180. The aspect shown in FIG. 9 is one in which the image buffer memory 182 accompanies the print controller 180; however, the image memory 174 may also serve as the image buffer memory 182. Also possible is an aspect in which the print controller 180 and the system controller 172 are integrated to form a single processor.

The head driver 184 generates drive signals for driving the heating elements 155, 166 (see FIGS. 8A and 8B) of the heads 150, 160 corresponding to the respective ink colors, on the basis of the print data supplied from the print controller 180, and the drive signals thus generated are supplied to the heating elements 155, 166. A feedback control system for maintaining constant drive conditions for the heads 150, 160 may be included in the head driver 184.

As described with reference to FIG. 6, the print determination unit 124 is a block including the line sensor, which reads in the image printed on the recording medium 116, performs various signal processing operations, and the like, and determines the print situation (presence/absence of ejection, variation in droplet ejection, and the like), these determination results being supplied to the print controller 180. In other words, as described above, a portion of the print determination unit 124 functions as the dot information acquisition unit 18 shown in FIG. 1.

Furthermore, according to requirements, the print controller 180 makes various corrections with respect to the print head 50 on the basis of information obtained from the print determination unit 24.

As stated above, according to the present invention, the ink volume data is corrected by using the second correction coefficients calculated by means of the procedure described above, and therefore it is possible to achieve effective correction with respect to the image density, even if the large nozzles and the small nozzles have different droplet ejection characteristics.

Furthermore, since the correction can be achieved while maintaining a uniform conveyance amount of the recording medium, rather than changing the conveyance amount in accordance with the differences in the droplet ejection characteristics of the large nozzles and the small nozzles, then no burden is placed on the conveyance system and the overall size of the apparatus can be reduced, as well as lowering costs.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

large nozzles having large size nozzle openings to eject large droplets of liquid, the large droplets being deposited onto a recording medium and forming large dots;

small nozzles having small size nozzle openings of smaller size than the large size nozzle openings so as to eject small droplets of the liquid of volume smaller than the large droplets, the small droplets being deposited onto the recording medium and forming small dots smaller than the large dots;

a conversion processing device which converts input image data into ink volume data;

a dot information acquisition device which acquires dot information from the dots deposited on the recording medium relating to the large dots and the small dots on the recording medium; and a correction processing device which corrects the ink volume data according to the dot information.

2. The image forming apparatus as defined in claim 1, wherein the correction processing device corrects the ink volume data according to dot formation rates of the large nozzles and the small nozzles as calculated from the ink volume data.

3. The image forming apparatus as defined in claim 1, wherein the dot information indicates dot formation positions of the large dots and the small dots on the recording medium.

4. The image forming apparatus as defined in claim 1, wherein the dot information indicates densities of the large dots and the small dots on the recording medium.

5. An image forming method for an image forming apparatus having large nozzles and small nozzles the method comprising the steps of:

controlling the large nozzles to eject large size droplets of liquid through large size nozzle openings to deposit large size droplets onto a recording medium;

controlling the small nozzles to eject small size droplets of liquid through small size nozzle openings that are smaller in size than the large size openings to deposit small size droplets onto the recording medium;

converting input image data into ink volume data;

acquiring dot information from the dots deposited on the recording medium relating to the large dots and the small dots on the recording medium;

calculating correction coefficients for the ink volume data according to the dot information; and applying the correction coefficients to the ink volume data.

* * * * *